US005670282A

United States Patent [19]

Judd et al.

[11] Patent Number: 5,670,282

[45] Date of Patent: Sep. 23, 1997

[54] METHOD FOR FORMING SILVER HALIDE GRAINS WITH MEASUREMENT OF ION CONCENTRATIONS

[75] Inventors: H. Glenn Judd; Yun Chea Chang, both of Rochester, N.Y.

[73] Assignee: Eastman Kodak Company, Rochester, N.Y.

[21] Appl. No.: 579,653

[22] Filed: Dec. 27, 1995

[51] Int. Cl.[6] ..... G03C 1/015; G03C 1/035

[52] U.S. Cl. ..... 430/30; 430/569

[58] Field of Search ..... 430/30, 569

[56] References Cited

U.S. PATENT DOCUMENTS

| | | | |
|---|---|---|---|
| 4,884,437 | 12/1989 | Constant et al. | 73/54.01 |
| 4,953,389 | 9/1990 | Schurch | 73/64.48 |
| 5,166,015 | 11/1992 | Ichikawa et al. | 430/30 |
| 5,303,030 | 4/1994 | Abraham et al. | 356/345 |
| 5,317,387 | 5/1994 | VanHengel et al. | 356/372 |
| 5,317,521 | 5/1994 | Lin et al. | 430/569 |
| 5,422,825 | 6/1995 | Lin et al. | 430/30 |

OTHER PUBLICATIONS

Takahashi et al, PHASE EQUILIBRIA OF AgI–AgBr System, Stats Ionica, 14, 1984, pp. 107–112.

*Primary Examiner*—Mark F. Huff
*Attorney, Agent, or Firm*—Paul A. Leipold

[57] ABSTRACT

The invention relates to a method for emulsion formation comprising providing a source of silver nitrate and a source of alkali halide bringing said sources together in a vessel, in the vessel measuring silver and each halide ion concentration, utilizing said measurements to determine what is the composition of the silver halide particles in said vessel, and controlling the sources of halide and nitrate to control said particles composition.

6 Claims, No Drawings

METHOD FOR FORMING SILVER HALIDE GRAINS WITH MEASUREMENT OF ION CONCENTRATIONS

FIELD OF THE INVENTION

This invention relates to the formation of silver halide grains for use in photographic elements. It particularly relates to the measurement of ion concentrations during the formation of silver halide grains in order to regulate the composition of the grains formed.

BACKGROUND OF THE INVENTION

Silver halide light sensitive microcrystals are used extensively in photographic industry. Very often in order to get different photographic properties, such as film speed, film contrast, etc., different solid solution of binary and ternary silver halide systems are prepared. In fact, binary systems like silver bromide-silver iodide (AgBrI), silver bromide-silver chloride (AgBrCl), and silver chloride-silver iodide (AgClI) exist in photographic products. Ternary system of silver chloride-silver bromide-silver iodide (AgClBrI) microcrystals are not uncommon.

The microcrystals are formed by coprecipitation of silver nitrate with various proportions of chloride bromide, and iodide aqueous solutions. The solid state composition of the resulting silver halide, thus photographic performance of the crystal, is greatly influenced by the precipitation temperature, silver ion and halide ion concentrations. Therefore, it is of great importance for photographic industry to know the solid-liquid equilibrium compositions of the silver halide system.

The presently used methodologies do not allow "real time" control of the process for all cases of mixed halides. The control in these cases is only based on past knowledge of the grains that will result from addition of the halide and silver at certain times and in certain quantities.

Problem to be Solved by the Invention

There remains a need for improved process control during formation of silver halide grains.

SUMMARY OF THE INVENTION

An object of the invention is to overcome disadvantages of the prior processes.

Another object of the invention is to permit better process control of silver halide grain formation.

A further object is to provide more predictability of the silver halide grains that will result from a particular formation process.

These and other objects of the invention generally are accomplished by a method for emulsion formation comprising providing a source of silver nitrate and a source of alkali halide, bringing said sources together in a vessel, in the vessel measuring silver and each halide ion concentration, utilizing said measurements to determine what is the composition of the silver halide particles in said vessel, and controlling the sources of halide and nitrate to control said particles composition.

Advantageous Effect of the Invention

The invention allows the control of silver halide grain formation in real time such that the process is continually verified in order to ensure that the product produced is the intended product. This allows cost savings, as the number of grains that are produced out of specification is reduced. Another advantage is that it allows easier design of the process for producing unique emulsion, rather than the trial and error process of forming grains and then analyzing to determine their properties and composition. Further, the method of the invention allows better prediction of the grains that will result from a certain processing technique without the need to perform multiple experiments to determine the effectiveness of new methods. This invention teaches a way of computing solid-phase activity coefficients such that accurate estimation of solid-liquid composition becomes possible for binary and ternary silver halide systems. The advantage of the invention is twofold: Simple, concise activity model for general mixed halide application and improvement in estimating solid-liquid compositions mixed halide systems.

DETAILED DESCRIPTION OF THE INVENTION

In the production of silver halide grains, there are several techniques that may be utilized. In one technique a silver nitrate, water, and gelatin solution is in a kettle to which is added a stream of halide such as sodium chloride or sodium bromide. The reverse may also be practiced with alkali halide in the kettle and silver nitrate added. In another technique, separate streams of silver nitrate and alkali halide are simultaneously added to a kettle that contains a water and gelatin solution. It is also possible that grains may be nucleated in a separate nucleation device and then added to a kettle of water and gelatin in which growth of the nucleated grains will take place by addition of halide salt and silver salt solutions. Such silver halide formation techniques are well known and represented by patents cited in Section I of *Research Disclosure* 308119 published December, 1989.

The grains formed for use in photographic materials may be of a variety of sizes and morphologies. They may be cubical or tabular grains as is well known in the art. Such grains are disclosed in the patents cited in Section I of *Research Disclosure* 308119.

In all of the above techniques and for all the grain morphologies, it is desirable that the structure of the grains be closely controlled in order that their composition and size be consistently reproducible. The invention method will allow real time control of the processing of the materials utilized in forming silver halide grains, thereby allowing much more reliable production of such grains.

Up until now there has been no general approach to treat the solid-liquid equilibrium in systems of mixed silver halide crystals. In some cases it has, therefore, been impossible to relate solution-phase parameters, such as silver ion concentration (activity), to solid composition. Preparation of such emulsions has generally been done by trial and error. Prior art attempted to address the equilibrium composition problem for the binary mixed halide systems with limited success. For example, Chateau (Chateau, M. H, and et al., Academie des Science Paris: Comptes Rendus, 254, 1783 (1962) and Chateau, M. H., Ph.D. Thesis, Univ of Paris, France (October 1963)) used a one-parameter Margules activity model to model the miscible crystal phases of AgCl-AgBr and AgBr-AgI systems, and the AgCl-rich region of the AgCl-AgI system. These models seem to work well for activity modeling in these systems, provided the correct solubilities for the different crystal structures are used. There are several limitations/drawbacks to Chateau's work. There are no provisions made for the AgI-rich miscible region, nor are there any provisions made for modeling the ternary system. Furthermore, the thermodynamics of immiscible regions are ignored. As a final complication, because Chateau's activity models are derived for each crystal structure, correct application of the model requires use of the thermodynamic quantities (e.g., solubility) pertaining to that crystal structure, which may not be known accurately. While this approach is theoretically sound, it requires modeling of crystal structures that are unstable or even hypothetical in some cases. Chateau represented the activity coefficients in AgBr-AgI system as follows;

$$RT(\ln\phi_{AgBr})=Mx_{AgI}^2 \quad (1)$$

$$RT(\ln\phi_{AgI})=M\,x_{AgBr}^2 \quad (2)$$

for the silver bromide rich crystal phase (FCC rock-salt structures) and $$RT(\ln\phi_{AgBr})=N\,x_{AgI}^2 \quad (3)$$

$$RT(\ln\phi_{AgI})=N\,x_{AgBr}^2 \quad (4)$$

for the silver iodide rich crystal phase (Hexagonal wurtzite structures). M and N are energy constants (cal/mol) with values of 756 cal/mol and 320 cal/mol respectively.

xi mole fraction of Agi in the solid-phase

ϕi activity coefficient of Agi in the solid-phase

T temperature in degrees Kelvin

R gas constant (1.989 cal/mol)

Using the above equations, one can estimate the solid and liquid compositions during AgBrI precipitation through the use of Equation 5, which is essentially the solid-liquid equilibrium equation.

$$a_{I^-}/a_{Br^-}=Ksp_{AgI}\phi_{AgI}x_{AgI}/Ksp_{AgBr}AgBr\phi_{AgBr}x_{AgBr} \quad (5)$$

where ϕ's and x's are activity coefficients and mole fractions in solid solution, respectively.

It is known that in order to have good estimates of solid-liquid compositions in mixed halide systems, one has to be able to solve the following equations with the correct values for the solid-phase activity coefficients (ϕi's)

$$a_{I^-}/a_{Br^-}=Ksp_{AgI}\phi_{AgI}x_{AgI}/Ksp_{AgBr}\phi_{AgBr}x_{AgBr} \quad (6)$$

$$a_{I^-}/a_{Cl^-}=Ksp_{AgI}\phi_{AgI}x_{AgI}/Ksp_{AgCl}\phi_{AgCl}x_{AgCl} \quad (7)$$

$$a_{Cl^-}/a_{Br^-}=Ksp_{AgCl}\phi_{AgCl}x_{AgCl}/Ksp_{AgBr}\phi_{AgBr}x_{AgBr} \quad (8)$$

$$a_{Ag^+}=\frac{K_{spAgCl}\cdot\phi_{AgCl}\cdot X_{AgCl}+K_{spAgBr}\cdot\phi_{AgBr}\cdot X_{AgBr}+K_{spAgI}\cdot\phi_{AgI}\cdot X_{AgI}}{a_{Cl^-}+a_{Br^-}+a_{I^-}} \quad (9)$$

where $a_{Ag^+}$ is the activity of free silver ions in solution. Silver ion activity can be measured potentiometrically using silver billet electrodes. The measured potential relative to an appropriate reference half-cell is related to the silver ion activity by the well-known Nerst equation $$E=E^\circ+\frac{RT}{nF}\ln(a_{Ag^+})+E_{junc}$$

E measured potential (milliVolts)

E° the standard cell potential (mV)

$E_{junc}$ the liquid junction potential (mV)

F Faraday's constant (96,485 C)

n number of electrons involved in redox reaction (n=1 for $Ag^+/Ag^\circ$)

Following case studies help explain how to apply the above Equations 6–9 to produce a mixed silver halide product of known composition.

Case A. Estimation of halide ion concentrations: When solid composition is known from balanced double jet precipitation with silver ion concentration monitored. One knows the values of x's and $a_{Ag}$, therefore, each halide concentration in solution can be estimated by solving Equations 6–9.

Case B. Estimation of silver ion concentration: When solid compositions are known from balanced double jet precipitation with halide ion concentration monitored. One arrives at silver ion concentration immediately from Equation 9.

Case C. Estimation of solid compositions: Also, if all the halide ion concentrations are known, then the solid compositions can be estimated using Equations 6–8, and silver ion activity from Equation 9.

All ionic concentrations can be calculated from ionic activities using extended versions of the Debye-Hückel equation (H. Takahashi, S. Tamaki, and S. Harada, "Phase Equilibria of AgI-AgBr System", Solid State Ionics 14(1984) 107–112). Solid-phase activity coefficients (ϕ's), however, need to be known accurately in order to obtain silver ion concentration. Solid-phase activity coefficients for all mixed silver halides are not available from prior art. As a result, photographic researchers have great difficulty in relating silver ion concentration to actual silver halide compositions in many cases. Conversely, knowing solid-liquid composition does not help in obtaining correct silver ion concentration when solid-phase activity coefficients are not known.

We have discovered that solid-phase activity coefficients can be represented by the following regardless of precipitation temperature and solid state compositions:

$$RT\ln(\phi_1)=\frac{(g\cdot W_{12})\cdot x_2^2+(g\cdot W_{13}+p\cdot W_{12}-W_{23})\cdot x_2\cdot x_3+(p\cdot W_{13})\cdot x_3^2}{(x_1+g\cdot x_2+p.x_3)^2} \quad (10)$$

$$RT\ln(\phi_2)=\frac{(W_{12})\cdot x_1^2+(W_{23}+p\cdot W_{12}-g\cdot W_{13})\cdot x_1\cdot x_3+(p\cdot W_{23})\cdot x_3^2}{(x_1+g\cdot x_2+p\cdot x_3)^2} \quad (11)$$

$$RT\ln(\phi_3)=\frac{(W_{13})\cdot x_1^2+(W_{23}+g\cdot W_{13}-p\cdot W_{12})\cdot x_1\cdot x_2+(g\cdot W_{23})\cdot x_2^2}{(x_1+g\cdot x_2+p\cdot x_3)^2} \quad (12)$$

$W_{12}$=400 cal/mol $W_{23}$=1787 cal/mol $x_1, x_2, x_3$, are mole fractions in solid solution $\phi_1, \phi_2, \phi_3$ are activity coefficients $W_{13}$=1850 cal/mol g=1,596 p=0.75

$W_{12}$ Energy parameter associated with mixing of AgCl and AgBr to form a solid solution.

$W_{23}$ Energy parameter associated with mixing of AgBr and AgI to form a solid solution.

$W_{13}$ Energy parameter associated with mixing of AgCl and AgI to form a solid solution.

g Dimensionless term describing the assymmetry in the AgCl-AgBr solid solution p Dimensionless term describing the assymmetry in the AgCl-AgI solid solution With the introduction of the above representations for activity coefficients, solid-liquid compositions in mixed halide systems can now be estimated reliably. The range of application of these solid-phase activity coefficients includes all temperatures and AgCl-AgBr-AgI compositions normally encountered in silver halide precipitation. This includes temperatures of 0°–100° C., halide concentrations to the solubility limit, and all mixed halide compositions. This activity model was derived using a continuous Gibbs energy function, and requires that the solubilities of δAgCl, δAgBr, βAgI be used throughout in Equations 6–9 for accurate During silver halide formation the VAg is measured. This is the silver ion voltage referenced against Ag/AgCl electrode; In order to control the system, it is necessary to have the correct values of the solid phase activity. It has been discovered that the solid phase activity coefficients can be accurately determined utilizing the equations 10, 11, and 12 as set forth below. With the results of the Formulas 10, 11, and 12 used in equations 6, 7, 8, and 9 it can solve for solid liquid equilibrium compositions and ultimately silver ion activity, which then will correspond to VAg. Therefore, with the measured VAg and the additional process information which is, for instance, the molar addition rate of the reactants and temperature, you can calculate the composition of the grain that is in the emulsion make at that moment. Since you have the composition of the grain at any moment, you can tell whether this is the grain that is intended to be produced. If the grain that you have calculated as in existence is not the desired grain, then the feed materials, temperature, and other process variables may be changed in order to affect the grain composition to result in the desired grain, morphology, and composition.

The method of the invention also would find use if a grain of known composition was to be treated further such as in a finishing process where additional silver and bromide was intended to be added to the surface of the grain. The measurement of the VAg during grain formation generally is carried out by the known techniques. These include potentiometry (calculate data).

After the calculations of the invention have resulted in a predicted grain composition, then if the grain composition needs to be modified, this may be done by control of parameters which includes rate of feed of the silver, rate of feed of the halide, change in temperature, or change in position of addition of the halide or silver to the reactor kettle.

After the formation of the grain is complete, it may be subjected to the normal washing and separation techniques in order to prepare the grains for utilization in photographic elements. The grain also was normally subjected to sensitization and other finishing processes to result in a grain sensitized to particular colors and increased sensitization.

The following examples illustrate the practice of this invention. They are not intended to be exhaustive of all possible variations of the invention. Parts and percentages are by weight unless otherwise indicated.

EXAMPLES

The invention can be better appreciated by reference to the following examples:

Example A (Comparative)

This example demonstrates the inaccuracy of estimation using method disclosed in prior art.

KBr was added to a reaction vessel at 70° C. containing 1 μmoles of silver bromide crystals of size 0.5 μm to a concentration of 1 mole/Liter. Silver ion activity was measured to be 5.72×10"M. Then KI was added to the vessel to a concentration of 0.3 mmole/liter with vigorous stirring. The solution was allowed to sit for 10 minutes at 70° C. Silver ion activity was then measured using a silver metal electrode of the first kind to be 4.45×10"M. Since the total bromide and iodide concentration were much greater than that of initial AgBr seeds, bromide and iodide ion concentrations remained essentially unchanged after recrystallization and equilibrium. The predicted silver ion activity using the present model is 4.42×10"M, which is very close to the measured value. The predicted silver ion activity using the prior model (Chateau Technique) is 4.25×10"M, which is approximately 5 percent in error. The solid-phase equilibrium composition estimated using the present model is 70.0 percent silver bromide, and 30.0 percent silver iodide. The solid-phase equilibrium composition using the prior model is 65 percent silver bromide, and 35 percent silver iodide. In order to correctly estimate the composition of the material in the method described here would require the use of the solid-phase activity model disclosed in this patent.

Example B (Invention)

This example demonstrates the accuracy of the present model in AgClI system.

A Silver chloro-idodide emulsion having a grain composition of 99 mole percent AgI was desired. It was produced in the following manner: KCl was added to a reaction vessel containing 43 g/L gelatin to a silver ion potential (VAg) of 150 mV (KCl=0.0125M) at 35° C. Then precisely 0.01 moles of 4 N AgNO3 and KCl are added into the highly stirred vessel over a 10 second period using precision syringe pumps. After a 10 second hold period to allow equilibration, six liters of aqueous solution containing 9.9 mmoles of KI are dumped into the kettle. After approximately 15 minutes the VAg stabilized to a value of approximately 150 mV. Our model predicted a solid-phase composition of 99.2 percent AgI, 0.8 percent AgCl based on this VAg. X-Ray Photoelectron Spectroscopic measurements of the solid- phase gave values of 99.2 percent AgI, 0.8 percent AgCl, precisely the predicted value. Similar accuracy was obtained for a number of similar experiments. Until now, no silver halide solid-phase activity model has existed for the AgI-AgCl hexagonal crystal phase and, therefore, it would be impossible to accurately estimate composition from VAg.

Example C (Invention)

This example demonstrates the use of the model for the ternary AgCl-AgBr-AgI case.

KCl, KBr, and KI were added to a clean vessel containing deionized water to concentrations of 0.2M, 0.0025M, and 2.5 μM, respectively. The halide solution was then heated to 70° C., and the measured silver ion potential was 63.3. XPS analysis of the solid-phase gave a composition of 30 percent AgCl, 55 percent AgBr, and 15 percent AgI. The new model predicted a silver ion potential of 59.7, and solid-phase compositions of 23 percent AgCl, 56 percent AgBr, and 21 percent AgI. While some error exists in the prediction, such a prediction has been impossible up to this point since there is no ternary solid-phase activity model for the AgCl-AgBr-AgI system. Therefore, manufacture of such materials would require this model if silver ion potential (VAg) is to be used to monitor and control composition.

The invention has been described in detail with particular reference to preferred embodiments thereof, but it will be understood that variations and modifications can be effected within the spirit and scope of the invention.

We claim:

1. A method for emulsion formation comprising providing a source of silver nitrate and a source of halide ion bringing said sources together in a vessel, in the vessel measuring silver ion and each halide ion concentration, utilizing said measurements to determine what is the composition of the silver halide particles in said vessel, and controlling the sources of halide ion and silver nitrate to control said particles composition, wherein the utilizing of said measurements to determine the composition of the particles comprises using Formulas 10, 11, and 12 to determine solid phase activity coefficients of AgCl, AgBr, and AgI, $$RT\ln(\phi_1) = \frac{(g \cdot W_{12}) \cdot x_2^2 + (g \cdot W_{13} + p \cdot W_{12} - W_{23}) \cdot x_2 \cdot x_3 + (p \cdot W_{13}) \cdot x_3^2}{(x_1 + g \cdot x_2 + p \cdot x_3)^2} \quad (10)$$

$$RT\ln(\phi_2) = \frac{(W_{12}) \cdot x_1^2 + (W_{23} + p \cdot W_{12} - g \cdot W_{13}) \cdot x_1 \cdot x_3 + (p \cdot W_{23}) \cdot x_3^2}{(x_1 + g \cdot x_2 + p \cdot x_3)^2} \quad (11)$$

$$RT\ln(\phi_3) = \frac{(W_{13}) \cdot x_1^2 + (W_{23} + g \cdot W_{13} - p \cdot W_{12}) \cdot x_1 \cdot x_2 + (g \cdot W_{23}) \cdot x_2^2}{(x_1 + g \cdot x_2 + p \cdot x_3)^2} \quad (12)$$

$W_{12}$=400 cal/mol $W_{23}$=1787 cal/mol $W_{13}$=1850 cal/mol q=1.596 p=0.75

$x_1$, $x_2$, $x_3$ are mole fractions

W12 Energy parameter associated with mixing of AgCl and AgBr to form a solid solution W23 Energy parameter associated with mixing of AgBr and AgI to form a solid solution W13 Energy parameter associated with mixing of AgCl and AgI to form a solid solution g Dimensionless term describing the assymmetry in the AgCl-AgBr solid solution p Dimensionless term describing the assymmetry in the AgCl-AgI solid solution $\phi_1$, $\phi_2$, $\phi_2$ are activity coefficients and then utilizing said coefficient to determine the composition of the silver halide particles using Equations 6–8

$$a_{I^-}/a_{Br^-} = Ksp_{AgI}\phi_{AgI} \cdot x_{AgI}/Ksp_{AgBr} \cdot \phi_{AgBr} \cdot x_{AgBr} \quad (6)$$

$$a_{I^-}/a_{Cl^-} = Ksp_{AgI}\phi_{AgI} \cdot x_{AgI}/Ksp_{AgCl}\phi_{AgCl} \cdot x_{AgCl} \quad (7)$$

$$a_{Cl^-}/a_{Br^-} = Ksp_{AgCl}\phi_{AgCl} \cdot x_{AgCl}/Ksp_{AgBr}\phi/_{AgBr} \cdot x_{AgBr} \quad (8)$$

where $a_I$—is the activity of free iodide ions in solution, $a_{Br}$—is the activity of free bromide ions in solution, $a_{Cl}$—is activity of free chloride ions in solution $\phi_{AgI}$, $\phi_{AgCl}$, $\phi_{AgBr}$ are solid phase activity coefficients, $x_{AgBr}$, $x_{AgI}$, $x_{AgCl}$ are mole fractions.

2. The method of claim 1 wherein said source of silver nitrate is placed in said vessel and said source of halide ion is then added to said vessel.

3. The method of claim 1 wherein said halide ion comprises bromide, chloride, and iodide.

4. The method of claim 1 wherein said halide ion comprises bromide and chloride.

5. The method of claim 1 wherein said measuring silver ion is a measurement of VAg.

6. The method of claim 1 wherein said controlling is within a tenth of a percent of predicated composition.

* * * * *